US006415780B1

(12) United States Patent
Proctor

(10) Patent No.: US 6,415,780 B1
(45) Date of Patent: Jul. 9, 2002

(54) BEARING SYSTEM FOR COMPOUND ARCHERY BOW

(76) Inventor: Robert Gene Proctor, Rte. 2 Box 64, Lenore, ID (US) 83541

( * ) Notice: Subject to any disclaimer, the term of this patent is extended or adjusted under 35 U.S.C. 154(b) by 25 days.

(21) Appl. No.: 09/704,871

(22) Filed: Nov. 2, 2000

Related U.S. Application Data

(60) Provisional application No. 60/167,637, filed on Nov. 26, 1999.

(51) Int. Cl.[7] ..... F41B 5/00
(52) U.S. Cl. ..... 124/25.6; 124/900
(58) Field of Search ..... 124/88, 89, 900, 124/25.6

(56) References Cited

U.S. PATENT DOCUMENTS 4,064,862 A * 12/1977 Groner ..... 124/25.6
4,338,910 A * 7/1982 Darlington ..... 124/25.6
4,340,025 A * 7/1982 Caldwell ..... 124/23.1
4,660,536 A * 4/1987 McPherson ..... 124/24.1
4,774,927 A * 10/1988 Larson ..... 124/25.6
4,887,582 A * 12/1989 Chattin ..... 124/25.6
5,040,520 A * 8/1991 Nurney ..... 124/25.6
5,211,155 A * 5/1993 Zamojski ..... 124/25.6
5,921,227 A * 7/1999 Allshouse et al. ..... 124/25.6
RE37,544 E * 2/2002 Darlington ..... 124/25.6

* cited by examiner

*Primary Examiner*—Paul N. Dickson
*Assistant Examiner*—Benjamin A Pezzlo
(74) *Attorney, Agent, or Firm*—Brian C. Trask

(57) ABSTRACT

A bearing support system for eccentric and idler pulleys used in archery compound bows. The support system allows use of bearings having reduced friction, including low cost ball bearing assemblies, and increases pulley stability by providing a wider bearing stance.

30 Claims, 3 Drawing Sheets

BEARING SYSTEM FOR COMPOUND ARCHERY BOW

Priority Claim: This application claims the priority of U.S. provisional patent application Ser. No. 60/167,637, filed Nov. 26, 1999 for BEARING SYSTEM FOR COMPOUND ARCHERY BOW.

BACKGROUND OF THE INVENTION

1. Field

This invention relates to bearing support systems for rotating archery bow elements. It is particularly directed to bearing support systems for use with rotating compound bow eccentric pulley members.

2. State of the Art

Compound archery bows commonly carry pulley members concentrically or eccentrically mounted on axles in association with respective bow limbs. These limbs extend in opposite directions from a grip (usually comprising a central portion of a handle riser). The rigging for compound bows includes a bow string trained around the pulley members of the system, the string being received by grooves or other features at the perimeters of the pulleys. Certain pulley members are conventionally mounted to rotate (pivot) on an axle within a notch at the distal end of the limb, or within a bracket structure carried by the limb tip. An additional leverage advantage may be provided by specialized pulleys, usually called "eccentrics" or "cams". Some bows are constructed with grooved idler wheels, or pulleys, at the limb tips, and carry the eccentric of the system on the handle riser or at some intermediate position on the bow limb. Other bows are constructed with an idler wheel mounted at one limb tip and a cam at the opposite limb tip. In any case, the eccentrics include a pivot hole which is substantially offset from center, whereby to provide for a reduction in the holding force felt at the nocking point of the bow string, as the string is moved to its fully drawn condition. This location of the pivot hole inherently positions the axle closely adjacent the perimeter of the eccentric, in some cases within a quarter of an inch of the cable track. Such close spacing doesn't allow room for a bearing system other than a simple sleeve bearing or bushing. Accordingly, it has become conventional practice to journal the pivot axle of an eccentric through a sleeve bearing mounted within the pivot hole of the eccentric. While bows have functioned well with this system, sleeve bearings inherently limit the wear life, accuracy and stability achievable with compound bow eccentric systems. Sleeve bearings or bushings also inherently possess increased friction compared to other, more desirable, bearing assemblies.

SUMMARY OF THE INVENTION

This invention provides a bearing system for rotating archery components, used in compound archery bows, which differs significantly from the simple journal bearings currently ubiquitous in the art. The utilization of a bearing system characterized by very low friction, as compared to sleeve bearings, constitutes a significant advance in the art. Moreover, the system of this invention provides for a wide stance between bearing surfaces at opposite sides of the pulley. Bearings which provide a rolling frictional interface for the pivot axle of the pulleys in the rigging of a compound bow are now practical, by virtue of this invention.

The present invention reduces rotational friction and enhances lateral stability of the supported rotating components. The system of this invention provides enhanced lateral stability of the rotating components typically by providing stable component mounting on paired, axially spaced apart, bearing elements. With this invention, it is now possible to mount eccentrics to a bow using rolling bearing supports, such as ball bearing assemblies. Other types of bearing elements may also advantageously be used with the present invention to reduce pulley wobble and decrease rotational friction. The present invention allows use of low cost, commercially available, ball bearing elements having a diameter too large to mount within certain rotating archery components, such as cam elements typically disposed at limb tips.

One embodiment according to this invention includes a first support structure configured to receive a first bearing, the first support structure being adapted to rotate with the pulley and arranged such that the first bearing is mounted substantially outside of the body of the pulley, or outside the body of a let-off cam component of a multicam eccentric. Certain exemplary embodiments of the invention also will have a second support structure adapted to rotate with the pulley and arranged to receive a second bearing mounted substantially outside of the body of the pulley. The first and second bearing assemblies may be characterized as providing rolling friction, and are typified by self-contained ball bearing assemblies. Bearing support structure may be fashioned as one or more modular support elements configured for a press-fit or other engagement within receiving structure of the pulley. The bearings typically are axially spaced apart by a distance corresponding approximately to the width of a working surface of a cam forming the pulley. The axial spacing provides a moment arm, to resist a pulley tipping moment and pulley wobble, having a length typically greater than a length given by of the sum of the width of the pulley body and a rotational clearance. The moment arm to resist pulley wobble may be greater than one-and-a-quarter times the width of the pulley body.

The invention can be embodied in a compound bow eccentric assembly of the type that mounts a pulley body to a limb by means of a pivot axle extending through a bearing arrangement. Such an embodiment may include a first bearing assembly constructed and arranged to provide a rolling friction interface for a pivot axle. The first bearing assembly generally includes a first bearing support configured to rotate with the body and to support a first rolling bearing element substantially outside of the body. Another embodiment might further include a second bearing assembly constructed and arranged to provide a rolling friction interface for the axle. The second bearing assembly can include a second bearing support configured to rotate with the body and to support a second rolling bearing element substantially outside of the body. The first and second bearing supports may be modular components structured to interface with structure carried by the body. Alternatively, the first and second bearing supports may be axially directed extensions from material forming the body. In any event, it is currently preferred for the bearings to be ball bearing assemblies.

The instant invention can function to mount a pulley body to a bow limb by means of a pivot axle extending through a bearing arrangement including a bearing assembly having a first bearing support which rotates with the body. The bearing assembly typically provides spaced apart supports for the axle at opposite sides of the pulley body. At least one such axle support is generally located on an opposite side of a plane from the body. A second bearing support which rotates with the body may further be included. First and second bearing supports may alternatively be affixed to a bow limb or riser. The bearing supports typically carry bearings to provide axle supports spaced apart by a distance. In any case, the instant invention provides a moment arm, substantially greater than the width of a working surface of a cam forming the pulley, functioning to resist wobble of the pulley. The space between individual bearings may be more than ⅛ inch. It is within contemplation also to use a single, extra long, bushing in combination with the axle bearing support structure of the instant apparatus. The axle supports may be described as providing a moment arm to resist a wobble moment, with the moment arm having a length greater than about one-and-a-quarter times the width of the pulley body.

The invention generally provides bearing support structure configured and arranged to secure first and second bearing elements spaced apart by a distance along a pivot axle whereby to provide increased stability of a pulley from wobble during pulley rotation. Bearing elements providing a rolling bearing interface between the pivot axle and the bearing support structure may be used. Preferred bearing elements include roller and ball bearing assemblies. Bushing elements are also workable. In any case, it is currently preferred to have a race element disposed between the pivot axle and the elements providing the rolling interface. Such a race element prevents premature wear of the axle. The bearing assemblies are typically secured in the support structure such that the bearing assemblies are spaced apart by a distance substantially on the order of a width of the pulley body. The bearing support structure, in certain preferred embodiments, may be fashioned as a hanger bracket affixed to a limb, a limb tip overlay affixed to a limb, a built-up area in a limb, or as a portion of a limb tip constructed to receive either the bearing assembly or a pivot axle.

These features, advantages, and alternative aspects of the present invention will be apparent to those skilled in the art from a consideration of the following detailed description taken in combination with the accompanying drawings.

BRIEF DESCRIPTION OF THE DRAWINGS

In the drawings, which illustrate what is currently regarded as the best modes for carrying out the invention.

DETAILED DESCRIPTION OF THE ILLUSTRATED EMBODIMENTS

Reference will now be made to the drawings in which the various elements of the invention will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
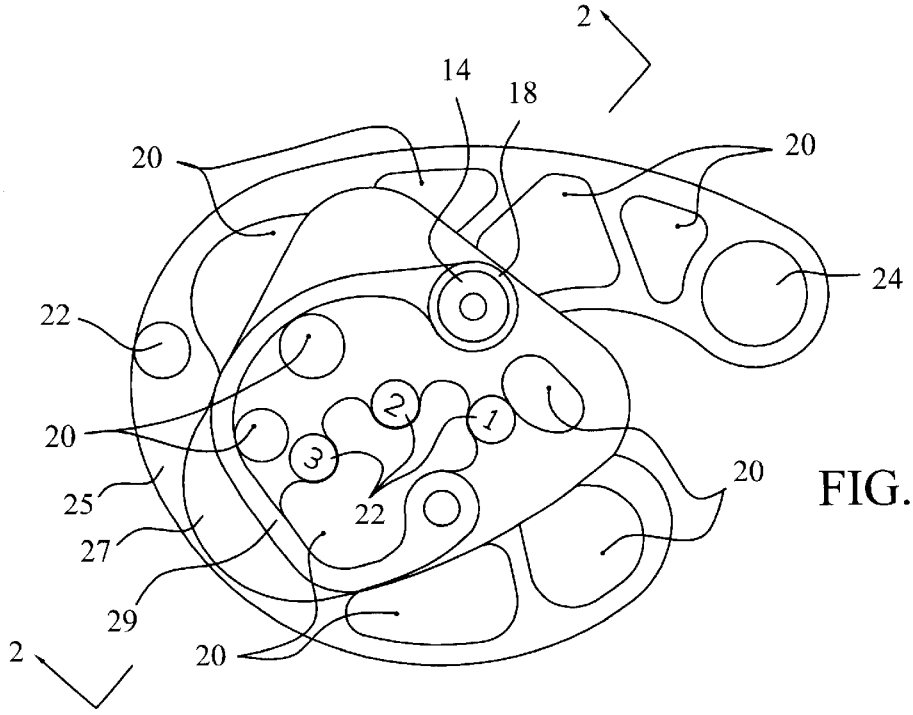
FIG. 1 is a side view of a bow eccentric illustrating a bearing support system according to this invention.

FIG. 1 illustrates a commercially available eccentric pulley, generally indicated at 9, for use in a compound bow. The exemplary eccentric 9 is adapted to mount to a bow using an embodiment of a bearing support system according to the instant invention and indicated generally at 10. The illustrated bearing support system 10 includes a sealed ball bearing assembly 14 and a modular bearing support element 18.

Eccentrics such as illustrated in FIG. 1 typically include weight reducing holes and one or more cable attach posts 22. Eccentrics may also include counterbalance weights, as illustrated at 24. Eccentric elements typically use various cam profiles to change the effective lever arm length and resulting let-off felt by the archer at full draw. Individual cam profiles may be tuned to increase energy stored in a bow limb and arrow speed. The instant bearing support system 10 may be used with eccentric elements having one or more stacked cams providing additional tuning of a bow's shooting characteristics.

Figure 2:
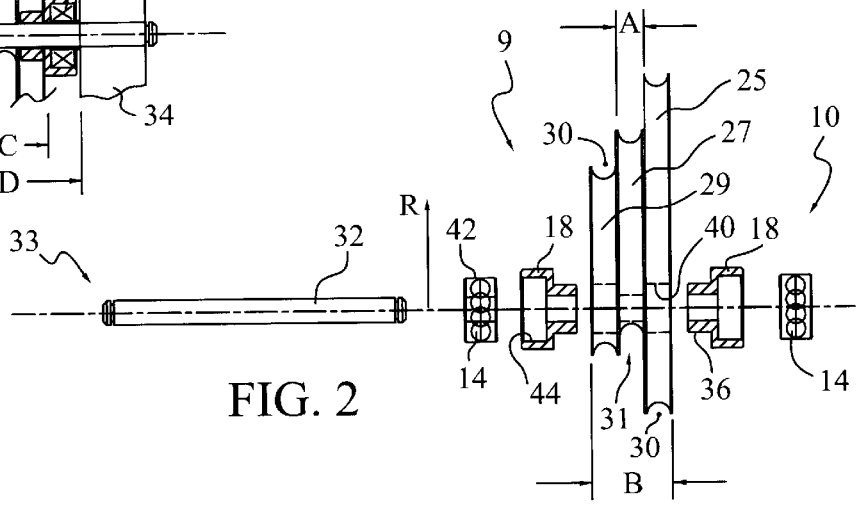
FIG. 2 is an exploded assembly front view in elevation of the eccentric of FIG. 1, taken through the section 2—2 and looking in the direction of the arrows.

FIGS. 1 and 2 illustrate the invention associated with an eccentric 9 having three stacked cams 25, 27, and 29; each cam having a different profile. Each illustrated cam has a working surface having a width defining the body of each individual cam, one of which is illustrated as length A in FIG. 2. In the three-cam illustrated in FIG. 2, cam 27 typically functions as a let-off cam to reduce draw weight. Cams 25 and 29 typically function as take-up cams. In the design of high performance cams, it is generally desirable for a let-off cam 27 to have a portion of its working surface, generally indicated at 31, spaced a minimum radius from the axle 32. This desirable minimum radius spacing necessarily limits the diametral size of a bearing element receivable within the let-off cam body. In the case of a single, or one-cam pulley, the body of the let-off cam 27 typically forms the entire body of the pulley 9.

The combined stacked cams produce an eccentric 9 having a body width illustrated by length B. An eccentric body width B may be defined as the length of a spacing between two planes; each plane being located on opposite sides of the total number of stacked cam working surfaces. The total width of an eccentric 9 may also include one or more step-like shoulders to provide rotational clearance for the eccentric from a bow limb or mounting structure. Certain manufacturing considerations also may produce such a shoulder, such as by machining the eccentric 9 from stock having a thickness in excess of the desired cam thickness. A shoulder may also be provided as a spacer for cable clearance. Rotational clearance may also conventionally be provided by an installed bushing or bearing having a small protrusion in an outboard direction from the eccentric body.

FIG. 2 best illustrates the radial distance R a cable, carried by groove-like receiving structure 30 of cams 25, 27, and 29, is displaced from a mounting axle 32. Any slop in the mounting of the eccentric 9 about axle 32 may lead to transverse wobble of the eccentric. The transverse wobbling of an eccentric 9 is detrimental to both arrow accuracy and speed. Wobble is amplified by the radial distance R, and transmitted to the cables, both dissipating energy and causing inconsistent vibrational response of a bow upon release of an arrow.

Conventional bushings, mounted substantially within the eccentric 9, provide a relatively narrow bearing stance. Cable tension applied at the cam's perimeter at a distance R from the axle may create a tipping moment tending to wobble the cam 9 while shooting an arrow. The wobble causing moment is resisted by forces generated between the cam bushing and axle 32. Such bushings suffer from wear at the axle rotation interface which increases transverse wobble.

Figure 3:
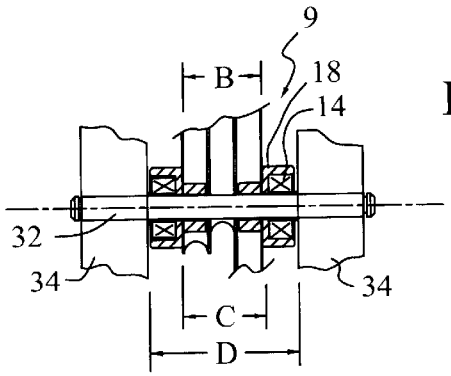
FIG. 3 is a front view in elevation, partially in section, of a portion of an eccentric mounted on a bow.

FIG. 3 illustrates a portion of an eccentric or pulley 9 mounted on axle 32 which is in turn received by mounting bracketry 34. The moment arm available in a conventional eccentric to resist the wobble or tipping moment is limited to the distance spanned by the width of a typical bushing, illustrated as length C. Clearance width required for rotation of the eccentric 9 is also included in illustrated length C. Illustrated length C may therefore be considered to be equal to the body width B of the pulley 9 plus a typical length to provide rotational clearance. Length C therefore accounts for any potential protuberance of a typical bushing from a pulley body. Rotational clearance is generally on the order of 1/16th of an inch, but in any case is significantly less than the width of a bearing 14. The improved bearing stance provided by the instant invention provides an appreciably longer resisting moment arm, illustrated as length D.

Mounting the bearing elements 14 outside of the cam 9 body, and especially outside of a let-off track defined substantially by the body of let-off cam 27, increases the resisting moment arm over eccentrics having a conventional design. The increased moment arm provided by the instant invention also decreases cam wobble for equivalent pulley bearing-to-axle fit. Thus, an eccentric 9 mounted with bearing elements outside the cam body would inherently possess improved stability against pulley wobble. Bushing bearing elements mounted in such fashion would have increased bearing life due to reduced force required between the bushing and axle to counter the tipping moment.

As best illustrated in FIG. 2, the bearing mounting system 10 may be embodied as a modular group of components, including a bearing support element 18. Support 18 is illustrated in position for press-fit engagement of stub 36 into receiving bore 40 carried by eccentric 9. Of course, it is to be realized that alternative assembly techniques may also be employed, including without limitation threading, gluing, or welding. Stub 36 may be structured to replace a conventional bushing of a commercially available eccentric, thereby providing an improved, wider, bearing stance and enhancing stability of the commercially available eccentric. An outer surface 42 of bearing 14 is typically press fit into bore 44 of support 18. An axle 32 may then be passed through mounting bracketry on the bow, through the bearings 14 carried by the instant system, and secured is by fasteners. The illustrated axle 32 is configured to receive split ring clips at opposite axle ends 33 after assembly of the cam onto a bow.

The illustrated modular system is currently preferred, but is not required for the practice of this invention. It is within contemplation to form an eccentric or idler from a single piece of material and having bearing support elements 18 protruding outboard of the main body. However, the preferred system offers reduced machining and material costs. The illustrated system may be adapted to many commercially available cams. A bearing support element 18 may be made from any suitable structural material, including plastics, composites, and metals. It is currently preferred to machine support elements 18 from a metal, and press-fit support elements 18 into receiving structure carried by the eccentric or idler pulley.

It is also within contemplation for one bearing element to fit substantially inboard a stacked, or multicam, body, and for one to protrude outboard. For example, in FIGS. 1 and 2, it is seen that cam 25 would easily accept a bearing element 14 for support at least substantially internal to the body of cam 25 without compromising the profile of the cable receiving structure 30 carried at the cam's working surface. Cam 29, on the other hand, may not provide sufficient radial clearance for such an internal rolling bearing element 14.

Figure 4:
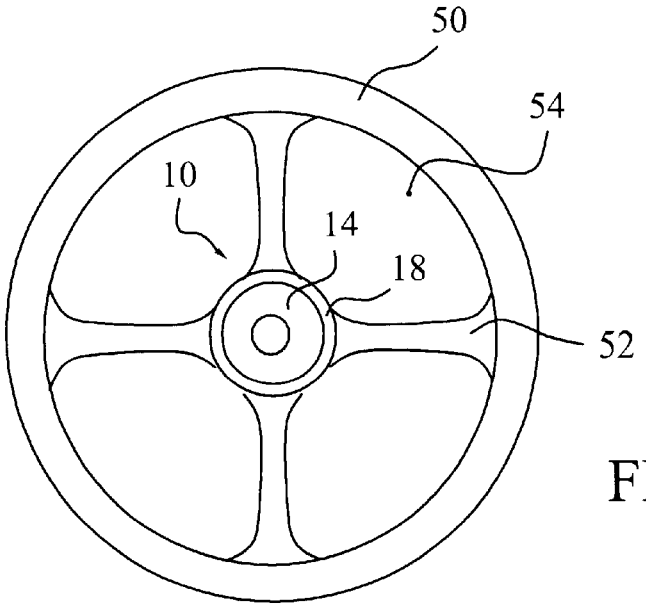
FIG. 4 is a side view of a bow idler illustrating a bearing support system according to this invention.

FIG. 4 illustrates an idler pulley 50 mounted on a bearing support system 10 according to the present invention. Representative idler 50 includes one or more spokes 52 spaced apart by weight reduction holes 54. Again, bearing support system 10 includes a modular bearing support element 18 in which is received bearing assembly 14. It is preferred to use a rolling bearing assembly 14, as illustrated. However a bushing element is also workable. One or more installed bearing supports 18 provide a bearing stance having an increased width to better resist wobble of the idler 50.

Figure 5:
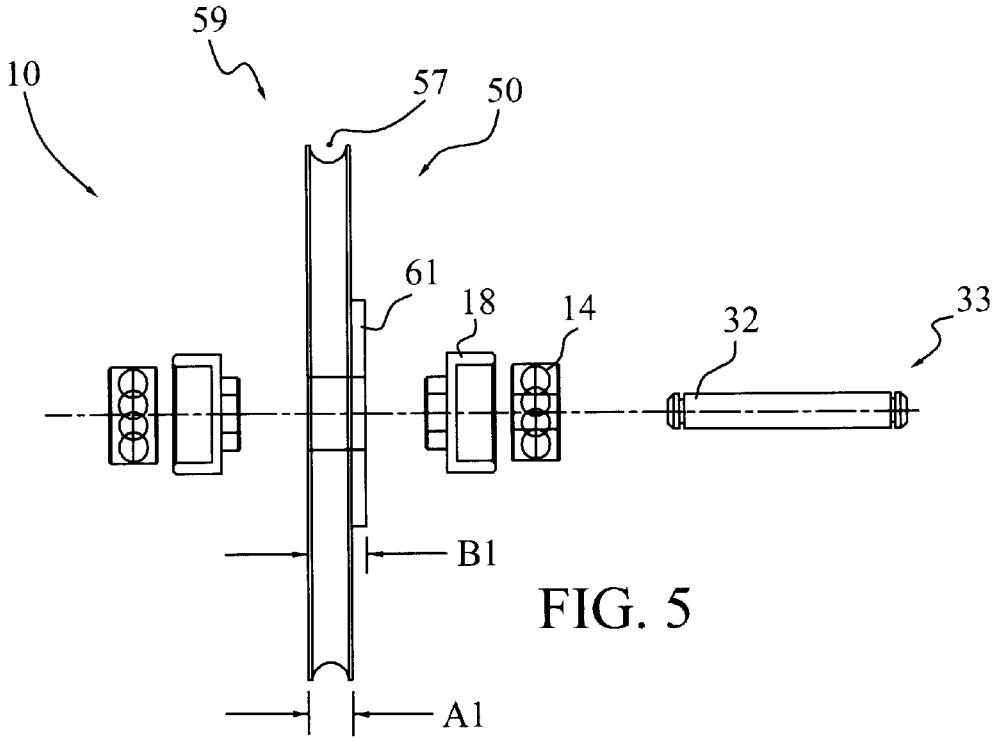
FIG. 5 is an assembly front view in elevation of the idler of FIG. 4.

With reference now to FIG. 5, cable support structure 57 of idler 50 is carried by working surface 59. Surface 59 has a width corresponding to the body width of idler 50, indicated by length A1. Idler 50 is illustrated as having a shoulder 61 forming a total idler width indicated as length B1. A second such shoulder may symmetrically be provided on the opposite side of pulley 50. One, two, or zero such shoulders may therefore be provided to give rotational clearance to the idler 50. If no such shoulders are present, the bushing element typically is installed in a conventional idler to provide rotational clearance. It may be appreciated that the illustrated idler 50 would accommodate a rolling bearing element 14 located substantially inboard the idler body without compromising the profile of surface 59. The resulting bearing stance would be more narrow, but may advantageously reduce spacing between bearing supports in certain cases.

Continuing to refer to FIG. 5, it may be appreciated that the bearing elements 14 are axially spaced apart by at least the width of the pulley working surface A1. As illustrated, bearings 14 are axially spaced apart by the total idler width B1 plus an additional amount accounting for support elements 18. Typical widths of pulley working surface A1 are on the order of 1/8 to 1/4 inches. Bearing assemblies 14 typically have similar corresponding widths. Therefore the instant invention may provide a moment arm to resist wobble on the order of three or four times the length of a moment arm provided by a conventional sleeve bearing mounting system. An increase in moment arm length by a factor of about three or more can be provided to either a pulley 50 or single cam eccentric using the instant bearing support system.

With reference to a three-cam eccentric, as illustrated in FIGS. 1–3, the improvement in tipping moment arm length is less dramatic, being on the order of two times as long as a conventional sleeve bearing system. The measured moment arm for one embodiment of a three-cam using the instant mounting system is about 1–1/16 inches. A conventional sleeve bushing would span only about 5/8 inches. For a three-cam eccentric having 1/4 inch cam widths, and paired support bearings, each mounted to extend about 3/16 inch outside the eccentric body, the ratio of increased moment arm is about $\{2*(3/16)+3*(1/4)\}:\{3*(1/4)+1/16\}$ or 1.125:0.7625. This can be normalized to a ratio of about 1.475 to 1. This later example assumes a conventional bushing would extend 1/16 inch past the eccentric body. This example demonstrates that the invention improves the moment arm by a factor of as low as about 1.5. Wider cam working surfaces and narrower bearings, and/or locating a bearing inside the body will reduce the ratio even more. A minimum ratio for the above three cam example, with one interior bearing, might be approximated by $\{1*(3/16)+3*(1/4)\}:\{3*(1/4)+1/16\}$ or 0.9375:0.7625. This result may be normalized to a ratio of about 1.229 to 1. This example shows that the instant invention realistically improves a moment arm length to prevent wobble by a factor of as low as about 1.2. Therefore a three-cam eccentric, mounted with the instant invention, would have a moment arm length to resist wobble of perhaps about one-and-a-quarter times the width of the eccentric body. A conventionally mounted eccentric would only provide a wobble resisting moment arm length substantially equal to the width of the eccentric body.

Bearing elements 14 are illustrated as ball bearing assemblies. Such bearing assemblies are preferred in the practice of this invention, as the reduced friction increases bow performance. Ball bearings 14 are advantageously widely available at relatively low cost. However, other rolling bearing elements and even bushings or sleeve bearings are within the scope of this invention. It is desirable to provide rolling bearing assemblies having an inner race to prevent axle wear. It has been found that needle bearings, which in some cases may be sized for mounting inboard certain eccentrics, can cause undesirable axle wear from the rolling element contact on the mounting axle 32. The improved bearing stance and resulting lower axle force of the present invention none-the-less tends to reduce such axle wear from rolling element contact with the axle.

Figure 6:
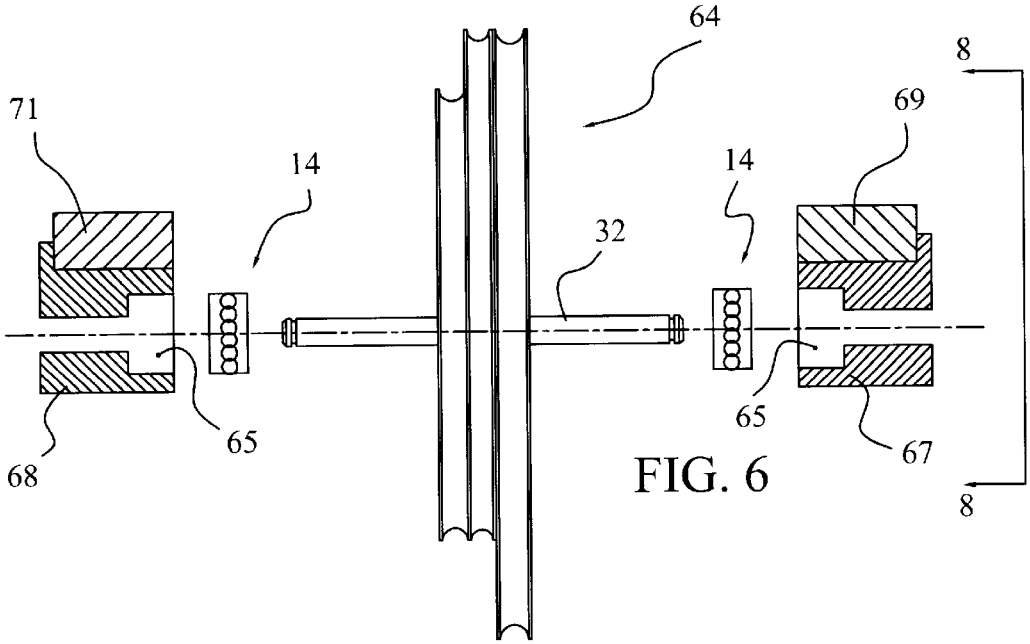
FIG. 6 is an exploded assembly front view in elevation of an alternative preferred bearing support system according to this invention.
Figure 7:
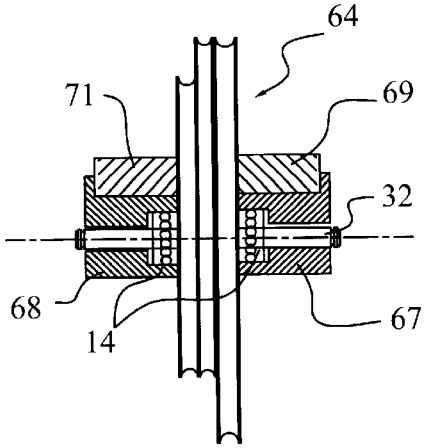
FIG. 7 is a front view in elevation of the bearing support system of FIG. 6.
Figure 8:
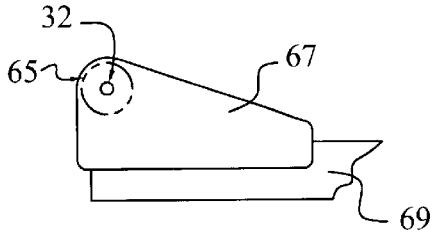
FIG. 8 is a side view of the limb tip illustrated in FIG. 6, looking in the direction of the arrows 8—8.

FIGS. 6 and 7 illustrate an alternative and currently preferred arrangement for mounting bearing support structure according to the instant invention. Cam 64 is positioned for rotation on axle 32. Axle 32 is supported on opposite sides of cam 64 by bearings 14. Bearing assemblies 14 are received in bores 65 in limb-tip overlays 67 and 68. Limb-tip overlays 67 and 68 are secured to limb tip elements 69 and 71, typically with an adhesive joint. FIG. 8 illustrates a typical limb-tip overlay from a side-view perspective. It is within contemplation to replace limb-tip overlays 67 and 68 with other equivalent functioning bearing support structure, including: bearing hanger brackets, built-up areas in the limbs themselves, or simply holes in the limb blank. Bearing support structure, according to the present invention, provides spaced support for a cam axle 32 to form a bearing stance having a width greater than a cam body width and functioning to resist cam wobble. At least one bearing support structure located substantially outside of the pulley let-off track affords the use of larger diameter bearings having rolling bearing elements to reduce friction during pulley rotation.

With reference to FIG. 7, a cam 64 may be installed on a bow by placing cam 64 between bearing assemblies 14 installed in limb-tip overlays 67 and 68. Of course, other bearing support structure may replace the overlays 67 and 68 in alternative mounting arrangements. For instance, bearings 14 are not required to be received in machined bores. It is within contemplation to use other mounting structure, including multipiece bracketry having separation planes with a normal vector oriented substantially transverse to the pivot axle. In such a mounting configuration. the bearings may be mounted on the pivot axle 32 as a first step. The resulting cam/bearing assembly may then be secured in place on the bow by assembly of the multipiece bracket. One advantage provided by such a multipiece mounting system is that the cam and bearings may conveniently be press fit assembled onto a pivot axle 32 to minimize cam wobble.

Continuing to refer to FIG. 7, an axle 32 is slid through receiving bores in each of the respective components, including limb-tip overlays 67 and 68, bearings 14, and cam 64. A press-fit engagement between cam 64 and axle 32 is generally desired, although not necessary to obtain benefit from the instant invention. A snug fit, however, is generally desired to minimize pulley wobble with respect to the pivot axle 32. The axle 32 may be secured from inadvertent removal from an assembled position, if desired, by mechanical fasteners, or some other retaining system. One type of exemplary mechanical fastener includes a self-biased, spring clip element, typified by split rings widely known in the art.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for mounting a pulley, carried by an axle, to a compound bow, comprising:

first support structure configured to receive a first bearing, said first support structure being adapted to rotate with a body of said pulley and arranged such that said first bearing is mounted substantially outside of said pulley body for engagement with said axle.

2. The apparatus of claim 1, wherein said first bearing comprises a bearing assembly characterized by rolling friction.

3. The apparatus of claim 2, wherein said first bearing comprises a self-contained ball bearing assembly.

4. The apparatus of claim 1, wherein said first support structure comprises a modular support element configured for engagement within receiving structure of said pulley.

5. The apparatus of claim 4, wherein said first bearing comprises a ball bearing assembly.

6. The apparatus of claim 1, further comprising:

second support structure configured to receive a second bearing, said second support structure being adapted to rotate with said pulley and arranged such that said second bearing is mounted substantially outside of said pulley body for engagement with said axle.

7. The apparatus of claim 6, wherein said first and second bearings comprise ball bearing assemblies.

8. The apparatus of claim 1, said first bearing being axially spaced apart from a second bearing by a distance comprising the width of a working surface of said pulley.

9. The apparatus of claim 1, further comprising a second bearing, said first and second bearings providing a moment arm, to resist a pulley tipping moment, having a length comprising the sum of a width of said pulley body, a width of a bearing, and a rotational clearance.

10. The apparatus of claim 1, further comprising a second bearing, said first and second bearings configured to provide a moment arm to resist a wobble moment, the moment arm comprising a length about three times a width of said pulley body.

11. The apparatus of claim 1, further comprising a second bearing, the first and second bearings configured to provide a moment arm to resist a wobble moment, said moment arm comprising a length greater than about one-and-a-quarter times a width of said pulley body.

12. In a compound bow eccentric assembly of the type that mounts a pulley to a limb by means of a pivot axle extending through a bearing arrangement, the improvement which comprises utilizing a first bearing support being configured to support a first rolling bearing element substantially outside of a let-off cam body portion of said pulley.

13. The improvement according to claim 12, further including a second bearing support being configured to support a second rolling bearing element substantially outside of said let-off cam body.

14. The improvement according to claim 13, said first and second bearing supports comprising modular components structured to interface in engagement with structure carried by said pulley.

15. The improvement according to claim 13, said first and second bearing supports comprising axially directed extensions of material forming said pulley.

16. The improvement according to claim 13, said first and second bearings comprising ball bearing assemblies.

17. In a compound bow eccentric assembly of the type that mounts a pulley body to a limb by means of a pivot axle extending through a bearing arrangement, the improvement which comprises utilizing a bearing assembly having a first bearing support to receive a first rolling bearing element comprising a first constraint for said axle, said assembly being constructed and arranged to provide spaced apart first and second constraints for said axle at opposite sides of said pulley body, at least one such constraint being substantially on an opposite side of a plane, defining said body's side, from said body.

18. The improvement according to claim 17, further including a second bearing support carrying a second rolling bearing element, said first and second bearing elements providing first and second axle constraints being spaced apart along a length of said axle by more than ⅛ inch.

19. The improvement according to claim 18, said first and second bearing elements being spaced apart by more than ¼ inch.

20. The improvement according to claim 18, said first and second axle constraints being configured to provide a moment arm to resist a wobble moment, said moment arm comprising a length about one-and-a-quarter times a width of said pulley body.

21. In a compound bow assembly of the type that mounts a pulley body to a limb by means of a pivot axle extending through a bearing arrangement, the improvement which comprises providing bearing support structure configured and arranged to secure first and second bearing elements spaced apart by a distance along said axle whereby to enhance stability of said pulley from wobble during pulley rotation, said bearing elements being structured to provide a rolling bearing interface between said pivot axle and said support structure.

22. The improvement according to claim 21, said bearing elements each comprising a race element disposed between said axle and said rolling interface.

23. The improvement according to claim 22, said bearing elements comprising ball bearing assemblies.

24. The improvement according to claim 21, said distance comprising a width of said body.

25. The improvement according to claim 21, said distance comprising about a width of a let-off cam body portion of said pulley body.

26. The improvement according to claim 21, said support structure being configured to rotate with said pulley body.

27. The improvement according to claim 21, said support structure comprising a limb tip overlay affixed to said limb.

28. The improvement according to claim 21, said support structure comprising a built-up area of material forming said limb.

29. The improvement according to claim 21, said support structure comprising a through-hole in a tip of said limb.

30. The improvement according to claim 21, said support structure comprising a bearing hanger bracket affixed to said limb.

* * * * *